US009576518B2

(12) United States Patent
Zuo et al.

(10) Patent No.: US 9,576,518 B2
(45) Date of Patent: Feb. 21, 2017

(54) DISPLAY PANEL AND DRIVING CIRCUIT THEREOF

(71) Applicant: SHENZHEN CHINA STAR OPTOELECTRONICS TECHNOLOGY CO., LTD, Shenzhen (CN)

(72) Inventors: Qingcheng Zuo, Shenzhen (CN); Gonghua Zou, Shenzhen (CN)

(73) Assignee: SHENZHEN CHINA OPTOELECTRONICS TECHNOLOGY CO., LTD, Shenzhen (CN)

( * ) Notice: Subject to any disclaimer, the term of this patent is extended or adjusted under 35 U.S.C. 154(b) by 142 days.

(21) Appl. No.: 14/417,808

(22) PCT Filed: Jan. 12, 2015

(86) PCT No.: PCT/CN2015/070501

§ 371 (c)(1),
(2) Date: Jan. 28, 2015

(87) PCT Pub. No.: WO2016/106819

PCT Pub. Date: Jul. 7, 2016

(65) Prior Publication Data

US 2016/0189587 A1 Jun. 30, 2016

(30) Foreign Application Priority Data

Dec. 31, 2014 (CN) ..... 2014 1 0854645

(51) Int. Cl.
*G09G 3/20* (2006.01)

(52) U.S. Cl.
CPC ..... *G09G 3/2003* (2013.01); *G09G 2310/08* (2013.01)

(58) Field of Classification Search
CPC ..... G09G 3/2003; G09G 2310/08
See application file for complete search history.

(56) References Cited

U.S. PATENT DOCUMENTS

| | | | | |
|---|---|---|---|---|
| 8,587,507 | B2 | 11/2013 | Hasegawa et al. | |
| 2007/0216668 | A1 | 9/2007 | Miyamoto et al. | |
| 2009/0066617 | A1* | 3/2009 | Chang | G09G 3/3233 345/83 |

FOREIGN PATENT DOCUMENTS

| | | | |
|---|---|---|---|
| CN | 101038735 | A | 9/2007 |
| CN | 101533616 | A | 9/2009 |
| CN | 101887676 | A | 11/2010 |
| WO | 9930132 | | 6/1999 |

* cited by examiner

*Primary Examiner* — Alexander Eisen
*Assistant Examiner* — Abhishek Sarma
(74) *Attorney, Agent, or Firm* — Mark M. Friedman

(57) ABSTRACT

A display panel and a driving circuit thereof are provided. The driving circuit includes a data signal supplying module for generating a data signal; a first selection signal generating module for providing a first selecting signal; a second selection signal generating module for providing a second selecting signal; a selecting module including selecting switch sets, which are utilized to receive the first and second selecting signals and output the data signal to a pixel array. The present invention is capable of decreasing a level switching frequency of the selecting signals.

18 Claims, 3 Drawing Sheets

DISPLAY PANEL AND DRIVING CIRCUIT THEREOF

TECHNICAL FIELD OF THE INVENTION

The present invention relates to a display technology, and in particular to a display panel and a driving circuit thereof.

BACKGROUND OF THE INVENTION

A conventional display panel usually includes a driving circuit. The typical driving circuit is utilized to control pixel units of the display panel for displaying corresponding images.

The technical solution that the typical driving circuit drives the display panel is generally as follows.

The driving circuit generates scanning signals, data signals and selecting signals. The scanning signals are transmitted to the pixel units via scan lines, and the data signals are transmitted to the pixel units via data lines. The selecting signals are utilized to selectively control the data signals to output to the pixel units.

In practice, the inventor at least found the following questions existing in the prior art.

The display panel requires a large number of wires for supporting the requirement of the display panel for high resolution. That is to say, the high-resolution display panel requires the more wires. However, wiring space on the display panel is restricted, and the number of the wires on the display panel cannot grow indefinitely. Thus, resolution enhancement of the display panel is also subject to the corresponding restriction.

Therefore, there is a significant need to provide a new technical solution for solving the above-mentioned technical problem.

SUMMARY OF THE INVENTION

An objective of the present invention is to provide a display panel and a driving circuit thereof, both of which have an advantage in reducing the number of wires on the display panel.

To achieve the foregoing objective, the technical solution of this invention is implemented as follows.

A driving circuit for controlling a pixel array in a corresponding display panel to display images, the driving circuit including: a data signal supplying module configured to generate a data signal, the data signal utilized to be provided for the pixel array; a first selection signal generating module utilized to provide a first selecting signal; a second selection signal generating module utilized to provide a second selecting signal; and a selecting module, the selecting module comprising: at least two selecting switch sets, the selecting switch sets electrically coupled to the first selection signal generating module, the second selection signal generating module, the data signal supplying module and the pixel array, the selecting switch sets utilized to receive the first selecting signal, the second selecting signal and the data signal, and utilized to output the data signal to the pixel array according to the first selecting signal and the second selecting signal; the selecting switch sets comprising: a first switch, the first switch electrically coupled to the first selection signal generating module and the data signal supplying module; a second switch, the second switch electrically coupled to the second selection signal generating module and the data signal supplying module; a third switch, the third switch electrically coupled to the first selection signal generating module and the data signal supplying module; a fourth switch, the fourth switch electrically coupled to the second selection signal generating module, the third switch and a third pixel columns of the pixel array; a fifth switch, the fifth switch electrically coupled to the second selection signal generating module, the first switch and a first pixel columns of the pixel array; a sixth switch, the sixth switch electrically coupled to the first selection signal generating module, the second switch and a second pixel column of the pixel array; the driving circuit further comprising a scanning signal supplying module, the scanning signal supplying module electrically coupled to the pixel array, the scanning signal supplying module utilized to generate a scanning signal and utilized to transmit the scanning signal to the pixel array.

In the above-mentioned driving circuit, the first switch includes: a first control terminal, the first control terminal electrically coupled to the first control terminal and the first selection signal generating module; a first input terminal, the first input terminal electrically coupled to the data signal supplying module; and a first output terminal, the first output terminal electrically coupled to the fifth switch; wherein the first control terminal is utilized to receive the first selecting signal, and utilized to control ON and OFF states of a first current channel between the first input terminal and the first output terminal according to the first selecting signal. The second switch includes: a second control terminal, the second control terminal electrically coupled to the second control terminal and the first selection signal generating module; a second input terminal, the second input terminal electrically coupled to the data signal supplying module; and a second output terminal, the second output terminal electrically coupled to the sixth switch; wherein the second control terminal is utilized to receive the second selecting signal, and utilized to control ON and OFF states of a second current channel between the second input terminal and the second output terminal according to the second selecting signal. The third switch includes: a third control terminal, the third control terminal electrically coupled to the first control terminal and the first selection signal generating module; a third input terminal, the third input terminal electrically coupled to the data signal supplying module; and a third output terminal, the third output terminal electrically coupled to the fourth switch; wherein the third control terminal is utilized to receive the first selecting signal, and utilized to control ON and OFF states of a third current channel between the third input terminal and the third output terminal according to the first selecting signal. The fourth switch includes: a fourth control terminal, the fourth control terminal electrically coupled to the second control terminal and the first selection signal generating module; a fourth input terminal, the fourth input terminal electrically coupled to the third output terminal; and a fourth output terminal, the fourth output terminal electrically coupled to the third pixel columns; wherein the fourth control terminal is utilized to receive the second selecting signal, and utilized to control ON and OFF states of a fourth current channel between the fourth input terminal and the fourth output terminal according to the second selecting signals. The fifth switch includes: a fifth control terminal, the fifth control terminal electrically coupled to the second control terminal and the first selection signal generating module; a fifth input terminal, the fifth input terminal electrically coupled to the first output terminal; and a fifth output terminal, the fifth output terminal electrically coupled to the first pixel columns; wherein the fifth control terminal is utilized to receive the second selecting signal, and utilized to control ON and OFF states of a fifth current channel between the fifth input terminal and the fifth output terminal according to the second selecting signal. The sixth switch includes: a sixth control terminal, the sixth control terminal electrically coupled to the first control terminal and the first selection signal generating module; a sixth input terminal, the sixth input terminal electrically coupled to the second output terminal; and a sixth output terminal, the sixth output terminal electrically coupled to the second pixel columns; wherein the sixth control terminal is utilized to receive the first selecting signal, and utilized to control ON and OFF states of a sixth current channel between the sixth input terminal and the sixth output terminal according to the first selecting signal.

In the above-mentioned driving circuit, the first current channel is utilized to open when the third current channel is in the ON state and to close when the third current channel is in the OFF state, and utilized to close when the sixth current channel is in the ON state and to open when the sixth current channel is in the OFF state; the second current channel is utilized to open when the fourth current channel is in the ON state and to close when the fourth current channel is in the OFF state, and utilized to close when the fifth current channel is in the ON state and to open when the fifth current channel is in the OFF state; the third current channel is utilized to open when the first current channel is in the ON state and to close when the first current channel is in the OFF state, and utilized to close when the sixth current channel is in the ON state and to open when the sixth current channel is in the OFF state; the fourth current channel is utilized to open when the second current channel is in the ON state and to close when the second current channel is in the OFF state, and utilized to close when the fifth current channel is in the ON state and to open when the fifth current channel is in the OFF state; the fifth current channel is utilized to close when the second current channel is in the ON state and to open when the second current channel is in the OFF state, and utilized to close when the fourth current channel is in the ON state and to open when the fourth current channel is in the OFF state; the sixth current channel is utilized to close when the first current channel is in the ON state and to open when the first current channel is in the OFF state, and utilized to close when the third current channel is in the ON state and to open when the third current channel is in the OFF state.

In the above-mentioned driving circuit, a duration of a high level of the first selecting signal is identical to a duration of a high level of the second selecting signal, and a duration of a low level of the first selecting signal is identical to a duration of a low level of the second selecting signal; the duration of the high level of the first selecting signal and the duration of the high level of the second selecting signal are 2K clock cycle units, and the duration of the low level of the first selecting signal and the duration of the low level of the second selecting signal are K clock cycle units, wherein K is a positive integer; a start time of a rising edge of the high level of the second selecting signal differs from a start time of a rising edge of the high level of the first selecting signal by K clock cycle units.

A driving circuit is used for controlling a pixel array in a corresponding display panel to display images, the driving circuit including: a data signal supplying module configured to generate a data signal, the data signal utilized to be provided for the pixel array; a first selection signal generating module utilized to provide a first selecting signal; a second selection signal generating module utilized to provide a second selecting signal; and a selecting module, the selecting module comprising: at least two selecting switch sets, the selecting switch sets electrically coupled to the first selection signal generating module, the second selection signal generating module, the data signal supplying module and the pixel array, the selecting switch sets utilized to receive the first selecting signal, the second selecting signal and the data signal, and utilized to output the data signal to the pixel array according to the first selecting signal and the second selecting signal.

In the above-mentioned driving circuit, the selecting switch sets includes: a first switch, the first switch electrically coupled to the first selection signal generating module and the data signal supplying module; a second switch, the second switch electrically coupled to the second selection signal generating module and the data signal supplying module; a third switch, the third switch electrically coupled to the first selection signal generating module and the data signal supplying module; a fourth switch, the fourth switch electrically coupled to the second selection signal generating module, the third switch and a third pixel columns of the pixel array; a fifth switch, the fifth switch electrically coupled to the second selection signal generating module, the first switch and a first pixel columns of the pixel array; a sixth switch, the sixth switch electrically coupled to the first selection signal generating module, the second switch and a second pixel column of the pixel array.

In the above-mentioned driving circuit, the first switch includes: a first control terminal, the first control terminal electrically coupled to the first control terminal and the first selection signal generating module; a first input terminal, the first input terminal electrically coupled to the data signal supplying module; and a first output terminal, the first output terminal electrically coupled to the fifth switch; wherein the first control terminal is utilized to receive the first selecting signal, and utilized to control ON and OFF states of a first current channel between the first input terminal and the first output terminal according to the first selecting signal. The second switch includes: a second control terminal, the second control terminal electrically coupled to the second control terminal and the first selection signal generating module; a second input terminal, the second input terminal electrically coupled to the data signal supplying module; and a second output terminal, the second output terminal electrically coupled to the sixth switch; wherein the second control terminal is utilized to receive the second selecting signal, and utilized to control ON and OFF states of a second current channel between the second input terminal and the second output terminal according to the second selecting signal. The third switch includes: a third control terminal, the third control terminal electrically coupled to the first control terminal and the first selection signal generating module; a third input terminal, the third input terminal electrically coupled to the data signal supplying module; and a third output terminal, the third output terminal electrically coupled to the fourth switch; wherein the third control terminal is utilized to receive the first selecting signal, and utilized to control ON and OFF states of a third current channel between the third input terminal and the third output terminal according to the first selecting signal. The fourth switch includes: a fourth control terminal, the fourth control terminal electrically coupled to the second control terminal and the first selection signal generating module, a fourth input terminal, the fourth input terminal electrically coupled to the third output terminal; and a fourth output terminal, the fourth output terminal electrically coupled to the third pixel columns; wherein the fourth control terminal is utilized to receive the second selecting signal, and utilized to control ON and OFF states of a fourth current channel between the fourth input terminal and the fourth output terminal according to the second selecting signal. The fifth switch includes: a fifth control terminal, the fifth control terminal electrically coupled to the second control terminal and the first selection signal generating module; a fifth input terminal, the fifth input terminal electrically coupled to the first output terminal; and a fifth output terminal, the fifth output terminal electrically coupled to the first pixel columns; wherein the fifth control terminal is utilized to receive the second selecting signal, and utilized to control ON and OFF states of a fifth current channel between the fifth input terminal and the fifth output terminal according to the second selecting signal. The sixth switch includes: a sixth control terminal, the sixth control terminal electrically coupled to the first control terminal and the first selection signal generating module; a sixth input terminal, the sixth input terminal electrically coupled to the second output terminal; and a sixth output terminal, the sixth output terminal electrically coupled to the second pixel columns; wherein the sixth control terminal is utilized to receive the first selecting signal, and utilized to control ON and OFF states of a sixth current channel between the sixth input terminal and the sixth output terminal according to the first selecting signal.

In the above-mentioned driving circuit, the first control terminal is electrically coupled to the first selection signal generating module via a first signal line; the second control terminal is electrically coupled to the second selection signal generating module via a second signal line; the third control terminal is electrically coupled to the first selection signal generating module via the first signal line; the fourth control terminal is electrically coupled to the second selection signal generating module via the second signal line; the fifth control terminal is electrically coupled to the second selection signal generating module via the second signal line; the sixth control terminal is electrically coupled to the first selection signal generating module via the first signal line.

In the above-mentioned driving circuit, the first current channel is utilized to open when the third current channel is in the ON state and to close when the third current channel is in the OFF state, and utilized to close when the sixth current channel is in the ON state and to open when the sixth current channel is in the OFF state; the second current channel is utilized to open when the fourth current channel is in the ON state and to close when the fourth current channel is in the OFF state, and utilized to close when the fifth current channel is in the ON state and to open when the fifth current channel is in the OFF state; the third current channel is utilized to open when the first current channel is in the ON state and to close when the first current channel is in the OFF state, and utilized to close when the sixth current channel is in the ON state and to open when the sixth current channel is in the OFF state; the fourth current channel is utilized to open when the second current channel is in the ON state and to close when the second current channel is in the OFF state, and utilized to close when the fifth current channel is in the ON state and to open when the fifth current channel is in the OFF state; the fifth current channel is utilized to close when the second current channel is in the ON state and to open when the second current channel is in the OFF state, and utilized to close when the fourth current channel is in the ON state and to open when the fourth current channel is in the OFF state; the sixth current channel is utilized to close when the first current channel is in the ON state and to open when the first current channel is in the OFF state, and utilized to close when the third current channel is in the ON state and to open when the third current channel is in the OFF state.

In the above-mentioned driving circuit, the first switch, the second switch, the third switch and the fourth switch are an N channel metal-oxide-semiconductor transistor, and the fifth switch and the sixth switch are a P channel metal-oxide-semiconductor transistor; or the first switch, the second switch, the third switch and the fourth switch are a P channel metal-oxide-semiconductor transistor, and the fifth switch and the sixth switch are an N channel metal-oxide-semiconductor transistor.

In the above-mentioned driving circuit, a duration of a high level of the first selecting signal is identical to a duration of a high level of the second selecting signal, and a duration of a low level of the first selecting signal is identical to a duration of a low level of the second selecting signal; the duration of the high level of the first selecting signal and the duration of the high level of the second selecting signal are 2K clock cycle units, and the duration of the low level of the first selecting signal and the duration of the low level of the second selecting signal are K clock cycle units, wherein K is a positive integer; a start time of a rising edge of the high level of the second selecting signal differs from a start time of a rising edge of the high level of the first selecting signal by K clock cycle units.

In the above-mentioned driving circuit, the duration of the high level of the scanning signal is 3K clock cycle units, and the duration of the low level of the scanning signal is also 3K clock cycle units.

A display panel includes: a pixel array; and a driving circuit, the driving circuit utilized to control the pixel array to display images, the driving circuit comprising: a data signal supplying module configured to generate a data signal, the data signal utilized to be provided for the pixel array; a first selection signal generating module utilized to provide a first selecting signal; a second selection signal generating module utilized to provide a second selecting signal; and a selecting module, the selecting module comprising: at least two selecting switch sets, the selecting switch sets electrically coupled to the first selection signal generating module, the second selection signal generating module, the data signal supplying module and the pixel array, the selecting switch sets utilized to receive the first selecting signal, the second selecting signal and the data signal, and utilized to output the data signal to the pixel array according to the first selecting signal and the second selecting signal.

In the above-mentioned display panel, the selecting switch sets includes: a first switch, the first switch electrically coupled to the first selection signal generating module and the data signal supplying module; a second switch, the second switch electrically coupled to the second selection signal generating module and the data signal supplying module; a third switch, the third switch electrically coupled to the first selection signal generating module and the data signal supplying module; a fourth switch, the fourth switch electrically coupled to the second selection signal generating module, the third switch and a third pixel columns of the pixel array; a fifth switch, the fifth switch electrically coupled to the second selection signal generating module, the first switch and a first pixel columns of the pixel array; a sixth switch, the sixth switch electrically coupled to the first selection signal generating module, the second switch and a second pixel column of the pixel array.

In the above-mentioned display panel, the first switch includes: a first control terminal, the first control terminal electrically coupled to the first control terminal and the first selection signal generating module; a first input terminal, the first input terminal electrically coupled to the data signal supplying module; and a first output terminal, the first output terminal electrically coupled to the fifth switch; wherein the first control terminal is utilized to receive the first selecting signal, and utilized to control ON and OFF states of a first current channel between the first input terminal and the first output terminal according to the first selecting signal. The second switch includes: a second control terminal, the second control terminal electrically coupled to the second control terminal and the first selection signal generating module; a second input terminal, the second input terminal electrically coupled to the data signal supplying module; and a second output terminal, the second output terminal electrically coupled to the sixth switch; wherein the second control terminal is utilized to receive the second selecting signal, and utilized to control ON and OFF states of a second current channel between the second input terminal and the second output terminal according to the second selecting signal; The third switch includes: a third control terminal, the third control terminal electrically coupled to the first control terminal and the first selection signal generating module; a third input terminal, the third input terminal electrically coupled to the data signal supplying module; and a third output terminal, the third output terminal electrically coupled to the fourth switch; wherein the third control terminal is utilized to receive the first selecting signal, and utilized to control ON and OFF states of a third current channel between the third input terminal and the third output terminal, according to the first selecting signal. The fourth switch includes: a fourth control terminal, the fourth control terminal electrically coupled to the second control terminal and the first selection signal generating module; a fourth input terminal, the fourth input terminal electrically coupled to the third output terminal; and a fourth output terminal, the fourth output terminal electrically coupled to the third pixel columns; wherein the fourth control terminal is utilized to receive the second selecting signal, and utilized to control ON and OFF states of a fourth current channel between the fourth input terminal and the fourth output terminal according to the second selecting signal; The fifth switch includes: a fifth control terminal, the fifth control terminal electrically coupled to the second control terminal and the first selection signal generating module; a fifth input terminal, the fifth input terminal electrically coupled to the first output terminal, and a fifth output terminal, the fifth output terminal electrically coupled to the first pixel columns, wherein the fifth control terminal is utilized to receive the second selecting signal, and utilized to control ON and OFF states of a fifth current channel between the fifth input terminal and the fifth output terminal according to the second selecting signal. The sixth switch includes: a sixth control terminal, the sixth control terminal electrically coupled to the first control terminal and the first selection signal generating module; a sixth input terminal, the sixth input terminal electrically coupled to the second output terminal; and a sixth output terminal, the sixth output terminal electrically coupled to the second pixel columns; wherein the sixth control terminal is utilized to receive the first selecting signal, and utilized to control ON and OFF states of a sixth current channel between the sixth input terminal and the sixth output terminal according to the first selecting signal.

In the above-mentioned display panel, the first control terminal is electrically coupled to the first selection signal generating module via a first signal line; the second control terminal is electrically coupled to the second selection signal generating module via a second signal line; the third control terminal is electrically coupled to the first selection signal generating module via the first signal line; the fourth control terminal is electrically coupled to the second selection signal generating module via the second signal line; the fifth control terminal is electrically coupled to the second selection signal generating module via the second signal line; the sixth control terminal is electrically coupled to the first selection signal generating module via the first signal line.

In the above-mentioned display panel, the first current channel is utilized to open when the third current channel is in the ON state and to close when the third current channel is in the OFF state, and utilized to close when the sixth current channel is in the ON state and to open when the sixth current channel is in the OFF state; the second current channel is utilized to open when the fourth current channel is in the ON state and to close when the fourth current channel is in the OFF state, and utilized to close when the fifth current channel is in the ON state and to open when the fifth current channel is in the OFF state; the third current channel is utilized to open when the first current channel is in the ON state and to close when the first current channel is in the OFF state, and utilized to close when the sixth current channel is in the ON state and to open when the sixth current channel is in the OFF state; the fourth current channel is utilized to open when the second current channel is in the ON state and to close when the second current channel is in the OFF state, and utilized to close when the fifth current channel is in the ON state and to open when the fifth current channel is in the OFF state; the fifth current channel is utilized to close when the second current channel is in the ON state and to open when the second current channel is in the OFF state, and utilized to close when the fourth current channel is in the ON state and to open when the fourth current channel is in the OFF state; the sixth current channel is utilized to close when the first current channel is hi the ON state and to open when the first current channel is in the OFF state, and utilized to close when, the third current channel is in the ON state and to open when the third current channel is in the OFF state.

In the above-mentioned display panel, the first switch, the second switch, the third switch and the fourth switch are an N channel metal-oxide-semiconductor transistor, and the filth switch and the sixth switch are a P channel metal-oxide-semiconductor transistor; or the first switch, the second switch, the third switch and the fourth switch are a P channel metal-oxide-semiconductor transistor, and the fifth switch and the sixth switch are an N channel metal-oxide-semiconductor transistor.

In the above-mentioned display panel, a duration of a high level of the first selecting signal is identical to a duration of a high level of the second selecting signal, and a duration of a low level of the first selecting signal is identical to a duration of a low level of the second selecting signal; the duration of the high level of the first selecting signal and the duration of the high level of the second selecting signal are 2K clock cycle units, and the duration of the low level of the first selecting signal and the duration of the to level of the second selecting signal are K clock cycle units, wherein K is a positive integer; a start time of a rising edge of the high level of the second selecting signal differs from a start time of a rising edge of the high level of the first selecting signal by K clock cycle units.

In the above-mentioned display panel, the duration of the high level of the scanning signal is 3K clack cycle units, and the duration of the low level of the scanning signal is also 3K clock cycle units.

In comparison with the prior art, the present invention has an advantage for reducing the number of wires on the display panel.

It is to be understood that both the foregoing general description and the following detailed description of the present invention are exemplary and explanatory and are intended to provide further explanation of the invention as claimed.

DETAILED DESCRIPTION OF THE INVENTION

As used herein, the word "exemplary" means "serving as an example, instance, or illustration. In addition, the articles "a" and "an" as used in this application and the appended claims may generally be construed to mean "one or more" unless specified otherwise or clear from context to be directed to a singular form.

Figure 1:
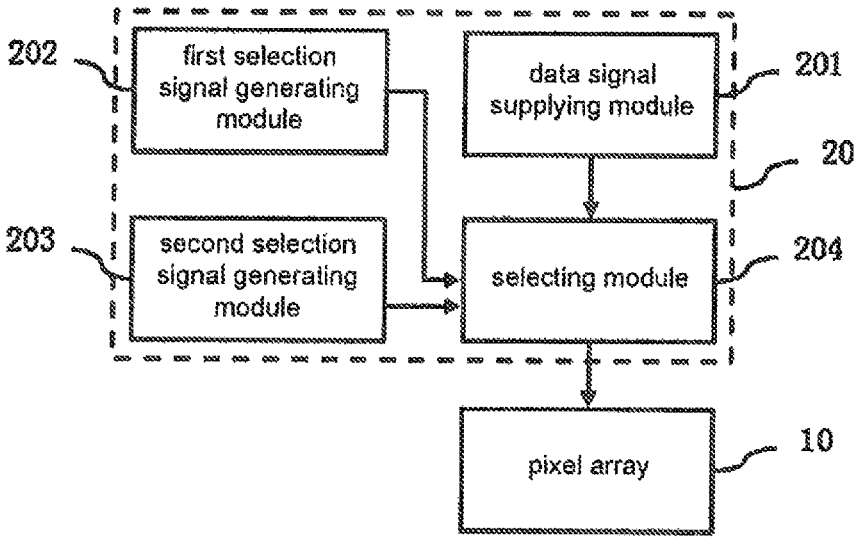
FIG. 1 is a block diagram illustrating a display panel of the present invention.

Referring to FIG. 1, FIG. 1 is a block diagram illustrating a display panel of the present invention.

The display panel of the present invention can be a TFT-LCD (Thin Film Transistor Liquid Crystal Display) panel, an OLED (Organic Light Emitting Diode) display panel, and so on.

The display panel of the present invention includes a pixel array 10 and a driving circuit 20.

The driving circuit 20 is electrically coupled to the pixel array 10 of the display panel, and the driving circuit 20 is utilized to control the pixel array 10 to display images. The driving circuit 20 includes a data signal supplying module 201, a first selection signal generating module 202, a second selection signal generating module 203, and a selecting module 204.

The data signal supplying module 201 is utilized to generate a data signal, and the data signal is utilized to be provided for the pixel array 10. The first selection signal generating module 202 is utilized to provide a first selecting signal MUX1. The second selection signal generating module 203 is utilized to provide a second selecting signal MUX2. The selecting module 204 includes at least two selecting switch sets, the selecting switch sets are electrically coupled to the first selection signal generating module 202, the second selection signal generating module 203, the data signal supplying module 201, and the pixel array 10. The selecting switch sets are utilized to receive the first selecting signal MUX1, the second selecting signal MUX2 and the data signal, and utilized to output the data signal to the pixel array 10 according to the first selecting signal MUX1 and the second selecting signal MUX2.

The driving circuit 20 further includes a scanning signal supplying module. The scanning signal supplying module is electrically coupled to the pixel array 10. The scanning signal supplying module is utilized to generate a scanning signal (gate signal) and utilized to transmit the scanning signal to the pixel array 10.

Figure 2:
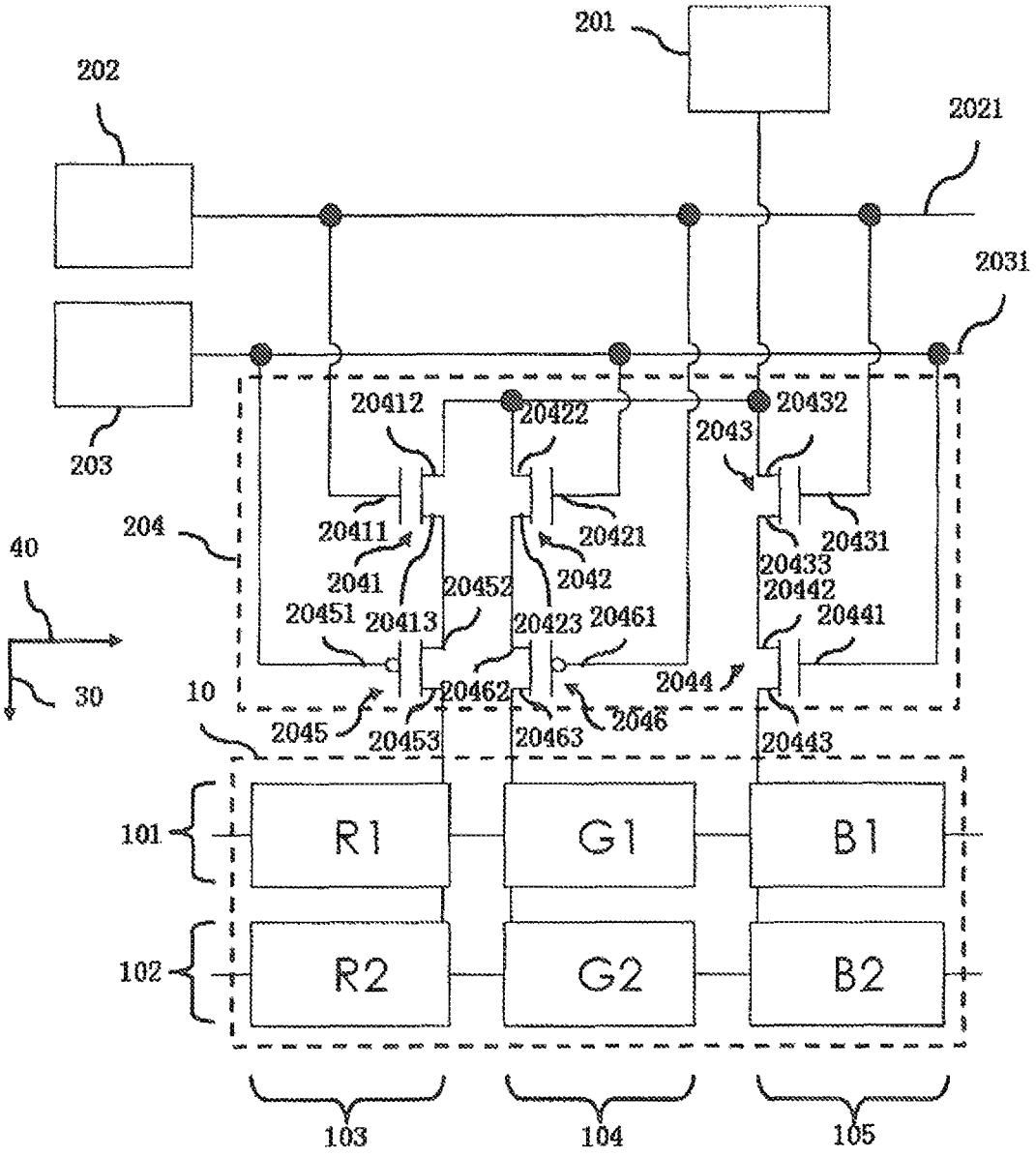
FIG. 2 is a circuit diagram illustrating a first embodiment of a display panel of FIG. 1.

Referring to FIG. 2, FIG. 2 is a circuit diagram illustrating a first embodiment of a display panel of FIG. 1.

In the embodiment, the pixel array 10 includes at least one first pixel row 101 and at least one second pixel row 102, and the first pixel row 101 and the second pixel row 102 are arranged in an array (one dimension) along a first direction 30, the first pixel 101 includes at least one first pixel R1, at least one second pixel G1, and at least one third pixel B1, and the first pixel R1, the second pixel G1, and the third pixel B1 are arranged in an array (one dimension) along a second direction 40, the second pixel 102 includes at least one fourth pixel R2, at least one fifth pixel G2, and at least one sixth pixel B2, and the fourth pixel R2, the fifth pixel G2, and the sixth pixel B2 are arranged in an array (one dimension) along the second direction 40. The pixel array 10 further includes at least one first pixel column 103, at least one second pixel column 104, and at least one third pixel column 105. The first pixel columns 103 herein includes the first pixel R1 and the fourth pixel R2; the second pixel columns 104 includes the second pixel G1 and the fifth pixel G2; the third pixel columns 105 includes the third pixel B1 and the sixth pixel B2. The first direction 30 herein is perpendicular to the second direction 40.

In the embodiment, the selecting switch sets includes a first switch 2041, a second switch 2042, a third switch 2043, a fourth switch 2044, a fifth switch 2045, and a sixth switch 2046.

The first switch 2041 is electrically coupled to the first selection signal generating module 202, the data signal supplying module 201, and the fifth switch 2045. The second switch 2042 is electrically coupled to the second selection signal generating module 203, the data signal supplying module 201, and the sixth switch 2046. The third switch 2043 is electrically coupled to the first selection signal generating module 202, the data signal supplying module 201, and the fourth switch 2044. The fourth switch 2044 is electrically coupled to the second selection signal generating module 203, the third switch 2043, and the third pixel columns 105 of the pixel array 10. The fifth switch 2045 is electrically coupled to the second selection signal generating module 203, the first switch 2041, and the first pixel columns 103 of the pixel array 10. The sixth switch 2046 is electrically coupled to the first selection signal generating module 202, the second switch 2042, and the second pixel columns 104 of the pixel array 10.

In the embodiment, all the first switch 2041, the second switch 2042, the third switch 2043, the fourth switch 2044, the fifth switch 2045, and the sixth switch 2046 are a triode. The first switch 2041 includes a first control terminal 20411, a first input terminal 20412, and a first output terminal 20413. The first control terminal 20411 is electrically coupled to the first selection signal generating module 202. Specifically, the first control terminal 20411 is electrically coupled to the first selection signal generating module 202 via a first signal line 2021. The first input terminal 20412 is electrically coupled to the data signal supplying module 201. The first output terminal 20413 is electrically coupled to the fifth switch 2045. The first control terminal 20411 herein is utilized to receive the first selecting signal MUX1, and utilized to control ON and OFF states of a first current channel between the first input terminal 20412 and the first output terminal 20413 according to the first selecting signal MUX1.

The second switch 2042 includes a second control terminal 20421, a second input terminal 20422, and a second output terminal 20423. The second control terminal 20421 is electrically coupled to the second selection signal generating module 203. Specifically, the second control terminal 20421 is electrically coupled to the second selection signal generating module 203 via a second signal line 2031. The second input terminal 20422 is electrically coupled to the data signal supplying module 201. The second output terminal 20423 is electrically coupled to the sixth switch 2046. The second control terminal 20421 herein is utilized to receive the second selecting signal MUX2, and utilized to control ON and OFF states of a second current channel between the second input terminal 20422 and the second output terminal 20423 according to the second selecting signal MUX2.

The third switch 2043 includes a third control terminal 20431, a third input terminal 20432, and a third output terminal 20433. The third control terminal 20431 is electrically coupled to the first selection signal generating module 202. Specifically, the third control terminal 20431 is electrically coupled to the first selection signal generating module 202 via the first signal line 2021. The third input terminal 20432 is electrically coupled to the data signal supplying module 201. The third output terminal 20433 is electrically coupled to the fourth switch 2044. The third control terminal 20431 herein is utilized to receive the first selecting signal MUX1, and utilized to control ON and OFF states of a third current channel between the third input terminal 20432 and the third output terminal 20433 according to the first selecting signal MUX1.

The fourth switch 2044 includes a fourth control terminal 20441, a fourth input terminal 20442, and a fourth output terminal 20443. The fourth control terminal 20441 is electrically coupled to the second selection signal generating module 203. Specifically, the fourth control terminal 20441 is electrically coupled to the second selection signal generating module 203 via the second signal line 2031. The fourth input terminal 20442 is electrically coupled to the third output terminal 20433. The fourth output terminal 20443 is electrically coupled to the third pixel columns 105. The fourth control terminal 20441 herein is utilized to receive the second selecting signal MUX2, and utilized to control ON and OFF states of a fourth current channel between the fourth input terminal 20442 and the fourth output terminal 20443 according to the second selecting signal MUX2.

The fifth switch 2045 includes a fifth control terminal 20451, a fifth input terminal 20452, and a fifth output terminal 20453. The fifth control terminal 20451 is electrically coupled to the second selection signal generating module 203. Specifically, the fifth control terminal 20451 is electrically coupled to the second selection signal generating module 203 via the second signal line 2031. The fifth input terminal 20452 is electrically coupled to the first output terminal 20413. The fifth output terminal 20453 is electrically coupled to the first pixel columns 103. The fifth control terminal 20451 herein is utilized to receive the second selecting signal MUX2, and utilized to control ON and OFF states of a fifth current channel between the fifth input terminal 20452 and the fifth output terminal 20453 according to the second selecting signal MUX2.

The sixth switch 2046 includes a sixth control terminal 20461, a sixth input terminal 20462, and a sixth output terminal 20463. The sixth control terminal 20461 is electrically coupled to the first selection signal generating module 202. Specifically, the sixth control terminal 20461 is electrically coupled to the first selection signal generating module 202 via the first signal line 2021. The sixth input terminal 20462 is electrically coupled to the second output terminal 20423. The sixth output terminal 20463 is electrically coupled to the second pixel columns 104. The sixth control terminal 20461 herein is utilized to receive the first selecting signal MUX1, and utilized to control ON and OFF states of a sixth current channel between the sixth input terminal 20462 and the sixth output terminal 20463 according to the first selecting signal MUX1.

In the embodiment, the first switch 2041, the second switch 2042, the third switch 2043, and the fourth switch 2044 are a NMOS (Negative channel Metal Oxide Semiconductor) transistor, and the fifth switch 2045 and the sixth switch 2046 are a PMOS (Positive channel Metal Oxide Semiconductor) transistor.

The first current channel is utilized to open when the third current channel is in the ON state and to close when the third current channel is in the OFF state, and utilized to close when the sixth current channel is in the ON state and to open when the sixth current channel is in the OFF state.

The second current channel is utilized to open when the fourth current channel is in the ON state and to close when the fourth current channel is in the OFF state, and utilized to close when the fifth current channel is in the ON state and to open when the fifth current channel is in the OFF state.

The third current channel is utilized to open when the first current channel is in the ON state and to close when the first current channel is in the OFF state, and utilized to close when the sixth current channel is in the ON state and to open when the sixth current channel is in the OFF state.

The fourth current channel is utilized to open when the second current channel is in the ON state and to close when the second current channel is in the OFF state, and utilized to close when the fifth current channel is in the ON state and to open when the fifth current channel is in the OFF state.

The fifth current channel is utilized to close when the second current channel is in the ON state and to open when the second current channel is in the OFF state, and utilized to close when the fourth current channel is in the ON state and to open when the fourth current channel is in the OFF state.

The sixth current channel is utilized to close when the first current channel is in the ON state and to open when the first current channel is in the OFF state, and utilized to close when the third current channel is in the ON state and to open when the third current channel is in the OFF state.

In the embodiment, a duration of a high level of the first selecting signal MUX1 is identical to a duration of a high level of the second selecting signal MUX2, and a duration of a low level of the first selecting signal MUX1 is identical to a duration of a low level of the second selecting signal MUX2.

The duration of the high level of the first selecting signal MUX1 and the duration of the high level of the second selecting signal MUX1 are 2K clock cycle units, and the duration of the low level of the first selecting signal MUX1 and the duration of the low level of the second selecting signal MUX2 are K clock cycle units. The duration of the high level of the scanning signal (including a first scanning signal Gate1 corresponding to the first pixel row 101 and a second scanning signal Gate2 corresponding to the second pixel row 102) is 3K clock cycle units, and the duration of the low level of the scanning signal is also 3K clock cycle units. K herein is a positive integer. For example, K=1.

A start time of a rising edge of the high level of the second selecting signal MUX2 differs from a start time of a rising edge of the high level of the first selecting signal MUX1 by K clock cycle units.

The start time of the rising edge of the high level of the second selecting signal MUX2 is within the duration of the high level of the first selecting signal MUX1 or within the duration of the high level of the second selecting signal MUX2.

Figure 3:
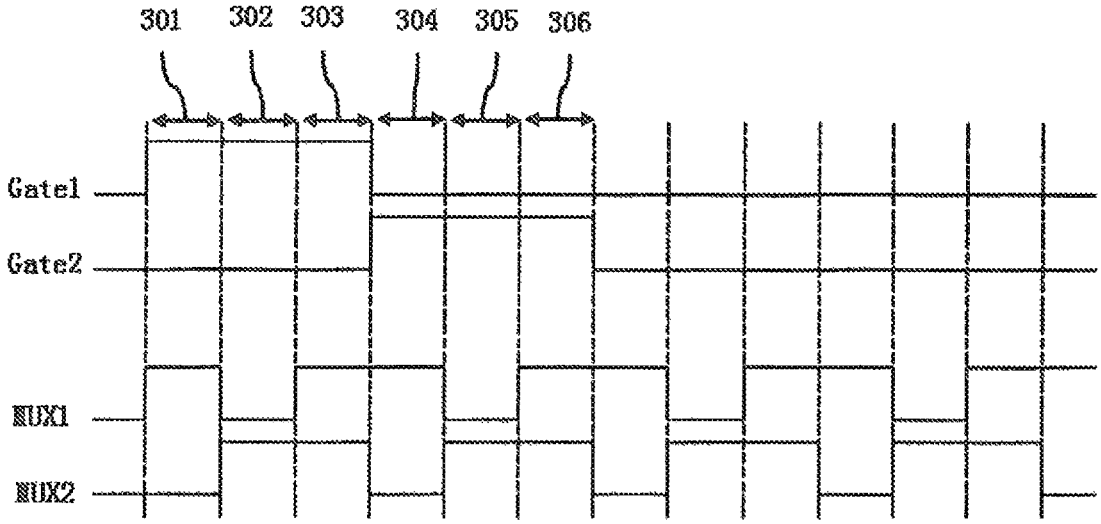
FIG. 3 is a schematic drawing illustrating waveforms of driving signal of the display panel of FIG. 2.

Referring to FIG. 3, FIG. 3 is a schematic drawing illustrating waveforms of driving signal of the display panel of FIG. 2.

The following uses that the first scanning signal Gate1 corresponding to the first pixel row 101 and the second scanning signal Gate2 corresponding to the second pixel row 102 open the switches on the pixels of the pixel array 10 in the high level and close the switches on the pixels in the low level as an example, and vice versa.

In a first clock cycle unit 301: the first scanning signal Gate1 generated by the scanning signal supplying module is in the high level, and the second scanning signal Gate2 is in the low level. Meanwhile, the switches of the first pixel R1, the second pixel G1, and the third pixel B1 are turned on; the switches of the fourth pixel R2, the fifth pixel G2, and the sixth pixel B2 are turned off.

The first selecting signal MUX1 is in the high level, and the second selecting signal MUX2 is in the low level. Meanwhile, the first current channel of the first switch 2041 is in the ON state; the second current channel of the second switch 2042 is in the OFF state; the third current channel of the third switch 2043 is in the ON state; the fourth current channel of the fourth switch 2044 is in the OFF state; the fifth current channel of the fifth switch 2045 is in the ON state; and the sixth current channel of the sixth switch 2046 is in the OFF state. The data signal is input into the first pixel R1 of the first pixel columns 103 via the first current channel and the fifth current channel, thereby charging the first pixel R1.

In a second clock cycle unit 302: the first scanning signal Gate1 still is in the high level, and the second scanning signal Gate2 still is in the low level. Meanwhile, the switches of the first pixel R1, the second pixel G1, and the third pixel B1 are turned on; the switches of the fourth pixel R2, the fifth pixel G2, and the sixth pixel B2 are turned off.

The first selecting signal MUX1 is in the low level, and the second selecting signal MUX2 is in the high level. Meanwhile, the first current channel is in the OFF state; the second current channel is in the ON state; the third current channel is in the OFF state; the fourth current channel is in the ON state; the fifth current channel is in the OFF state; and the sixth current channel is in the ON state. The data signal is input into the second pixel G1 of the second pixel columns 104 via the second current channel and the sixth current channel, thereby charging the second pixel G1.

In a third clock cycle unit 303: the first scanning signal Gate1 still is in the high level, and the second scanning signal Gate2 still is in the low level. Meanwhile, the switches of the first pixel R1, the second pixel G1, and the third pixel B1 are turned on; the switches of the fourth pixel R2, the fifth pixel G2, and the sixth pixel B2 are turned off.

The first selecting signal MUX1 is in the low level, and the second selecting signal MUX2 is in the high level. Meanwhile, the first current channel is in the ON state; the second current channel is in the ON state; the third current channel is in the ON state; the fourth current channel is in the ON state; the fifth current channel is in the OFF state; and the sixth current channel is in the OFF state. The data signal is input into the third pixel B1 of the third pixel columns 105 via the third current channel and the fourth current channel, thereby charging the third pixel B1.

In a fourth clock cycle unit 304: the first scanning signal Gate1 is in the low level, and the second scanning signal Gate2 is in the high level. Meanwhile, the switches of the first pixel R1, the second pixel G1, and the third pixel B1 are turn off; the switches of the fourth pixel R2, the fifth pixel G2, and the sixth pixel B2 are turned on.

The first selecting signal MUX1 keeps in the high level, and the second selecting signal MUX2 is in the low level. Meanwhile, the first current channel is in the ON state; the second current channel is in the OFF state; the third current channel is in the ON state; the fourth current channel is in the OFF state; the fifth current channel is in the ON state; and the sixth current channel is in the OFF state. The data signal is input into the fourth pixel R2 of the first pixel columns 103 via the first current channel and the fifth current channel, thereby charging the fourth pixel R2.

In a fifth clock cycle unit 305: the first scanning signal Gate1 still is in the low level, and the second scanning signal Gate2 still is in the high level. Meanwhile, the switches of the first pixel R1, the second pixel G1, and the third pixel B1 are turned off; the switches of the fourth pixel R2, the fifth pixel G2, and the sixth pixel B2 are turned on.

The first selecting signal MUX1 is in the low level, and the second selecting signal MUX2 is in the high level. Meanwhile, the first current channel is in the OFF state; the second current channel is in the ON state; the third current channel is in the OFF state; the fourth current channel is in the ON state; the fifth current channel is in the OFF state; and the sixth current channel is in the ON state. The data signal is input into the fifth pixel G2 of the second pixel columns 104 via the second current channel and the sixth current channel, thereby charging the fifth pixel G2.

In a with clock cycle unit 306: the first scanning signal Gate1 still is in the low level, and the second scanning signal Gate2 still is in the high level. Meanwhile, the switches of the first pixel R1, the second pixel G1, and the third pixel B1 are turned off; the switches of the fourth pixel R2, the fifth pixel G2, and the sixth pixel B2 are turned on.

The first selecting signal MUX1 is in the high level, and the second selecting signal MUX2 is in the high level. Meanwhile, the first current channel is in the ON state; the second current channel is in the ON state; the third current channel is in the ON state; the fourth current channel is in the ON state; the fifth current channel is in the OFF state; and the sixth current channel is in the OFF state. The data signal is input into the sixth pixel B2 of the third pixel columns 105 via the third current channel and the fourth current channel, thereby charging the sixth pixel B2.

The rest may be deduced by analogy until the entire screen is refreshed completely.

Through the above technical solution, the number of wires (signal lines) on the display panel can be effectively reduced, whereby the enhancement of the resolution of the display panel is not subject to the restriction of the number of the wires.

Moreover, the above technical solution is also beneficial to reduce the number of the drive signals of the driving circuit (for example, three types of selecting signals (first selecting signal, second selecting signal and third selecting signal) are reduced to two types of selecting signals (the first selecting signal, the second selecting signal)).

The difference between the second embodiment of the present invention and the above first embodiment is that: the first switch 2041, the second switch 2042, the third switch 2043, and the fourth switch 2044 are a PMOS (Positive channel Metal Oxide Semiconductor) transistor, and the fifth switch 2045 and the sixth switch 2046 are a NMOS (Negative channel Metal Oxide Semiconductor) transistor.

Although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure. In addition, while a particular feature of the disclosure may have been disclosed with respect to only one of several implementations, such feature may be combined with one or more other features of the other implementations as may be desired and advantageous for any given or particular application. Furthermore, to the extent that the terms "includes", "having", "has", "with", or variants thereof are used in either the detailed description or the claims, such terms are intended to be inclusive in a manner similar to the term "comprising."

While the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and realm of the present invention are within the scope as defined in the appended claims.

What is claimed is:

1. A driving circuit for controlling a pixel array in a corresponding display panel to display images, the driving circuit comprising:

a data signal supplying module utilized to generate a data signal, the data signal utilized to be provided for the pixel array;

a first selection signal generating module utilized to provide a first selecting signal;

a second selection signal generating module utilized to provide a second selecting signal; and a selecting module, the selecting module comprising:

at least two selecting switch sets, the selecting switch sets electrically coupled to the first selection signal generating module, the second selection signal generating module, the data signal supplying module and the pixel array, the selecting switch sets utilized to receive the first selecting signal, the second selecting signal and the data signal, and utilized to output the data signal to the pixel array according to the first selecting signal and the second selecting signal;

the selecting switch sets comprising:

a first switch, the first switch electrically coupled to the first selection signal generating module and the data signal supplying module;

a second switch, the second switch electrically coupled to the second selection signal generating module and the data signal supplying module;

a third switch, the third switch electrically coupled to the first selection signal generating module and the data signal supplying module;

a fourth switch, the fourth switch electrically coupled to the second selection signal generating module, the third switch and a third pixel columns of the pixel array;

a fifth switch, the fifth switch electrically coupled to the second selection signal generating module, the first switch and a first pixel columns of the pixel array;

a sixth switch, the sixth switch electrically coupled to the first selection signal generating module, the second switch and a second pixel column of the pixel array;

the driving circuit further comprising a scanning signal supplying module, the scanning signal supplying module electrically coupled to the pixel array, the scanning signal supplying module utilized to generate a scanning signal and utilized to transmit the scanning signal to the pixel array.

2. The driving circuit according to claim 1, wherein the first switch comprises:

a first control terminal, the first control terminal electrically coupled to the first control terminal and the first selection signal generating module;

a first input terminal, the first input terminal electrically coupled to the data signal supplying module; and a first output terminal, the first output terminal electrically coupled to the fifth switch;

wherein the first control terminal is utilized to receive the first selecting signal, and utilized to control ON and OFF states of a first current channel between the first input terminal and the first output terminal according to the first selecting signal;

the second switch comprising:

a second control terminal, the second control terminal electrically coupled to the second control terminal and the first selection signal generating module;

a second input terminal, the second input terminal electrically coupled to the data signal supplying module; and a second output terminal, the second output terminal electrically coupled to the sixth switch;

wherein the second control terminal is utilized to receive the second selecting signal, and utilized to control ON and OFF states of a second current channel between the second input terminal and the second output terminal according to the second selecting signal;

the third switch comprising:

a third control terminal, the third control terminal electrically coupled to the first control terminal and the first selection signal generating module;

a third input terminal, the third input terminal electrically coupled to the data signal supplying module; and a third output terminal, the third output terminal electrically coupled to the fourth switch;

wherein the third control terminal is utilized to receive the first selecting signal, and utilized to control ON and OFF states of a third current channel between the third input terminal and the third output terminal according to the first selecting signal;

the fourth switch comprising:

a fourth control terminal, the fourth control terminal electrically coupled to the second control terminal and the first selection signal generating module;

a fourth input terminal, the fourth input terminal electrically coupled to the third output terminal; and a fourth output terminal, the fourth output terminal electrically coupled to the third pixel columns;

wherein the fourth control terminal is utilized to receive the second selecting signal, and utilized to control ON and OFF states of a fourth current channel between the fourth input terminal and the fourth output terminal according to the second selecting signal;

the fifth switch comprising:

a fifth control terminal, the fifth control terminal electrically coupled to the second control terminal and the first selection signal generating module;

a fifth input terminal, the fifth input terminal electrically coupled to the first output terminal; and a fifth output terminal, the fifth output terminal electrically coupled to the first pixel columns;

wherein the fifth control terminal is utilized to receive the second selecting signal, and utilized to control ON and OFF states of a fifth current channel between the fifth input terminal and the fifth output terminal according to the second selecting signal;

the sixth switch comprising:

a sixth control terminal, the sixth control terminal electrically coupled to the first control terminal and the first selection signal generating module;

a sixth input terminal, the sixth input terminal electrically coupled to the second output terminal; and a sixth output terminal, the sixth output terminal electrically coupled to the second pixel columns;

wherein the sixth control terminal is utilized to receive the first selecting signal, and utilized to control ON and OFF states of a sixth current channel between the sixth input terminal and the sixth output terminal according to the first selecting signal.

3. The driving circuit according to claim 2, wherein the first current channel is utilized to open when the third current channel is in the ON state and to close when the third current channel is in the OFF state, and utilized to close when the sixth current channel is in the ON state and to open when the sixth current channel is in the OFF state;

the second current channel is utilized to open when the fourth current channel is in the ON state and to close when the fourth current channel is in the OFF state, and utilized to close when the fifth current channel is in the ON state and to open when the fifth current channel is in the OFF state;

the third current channel is utilized to open when the first current channel is in the ON state and to close when the first current channel is in the OFF state, and utilized to close when the sixth current channel is in the ON state and to open when the sixth current channel is in the OFF state;

the fourth current channel is utilized to open when the second current channel is in the ON state and to close when the second current channel is in the OFF state, and utilized to close when the fifth current channel is in the ON state and to open when the fifth current channel is in the OFF state;

the fifth current channel is utilized to close when the second current channel is in the ON state and to open when the second current channel is in the OFF state, and utilized to close when the fourth current channel is in the ON state and to open when the fourth current channel is in the OFF state;

the sixth current channel is utilized to close when the first current channel is in the ON state and to open when the first current channel is in the OFF state, and utilized to close when the third current channel is in the ON state and to open when the third current channel is in the OFF state.

4. The driving circuit according to claim 1, wherein a duration of a high level of the first selecting signal is identical to a duration of a high level of the second selecting signal, and a duration of a low level of the first selecting signal is identical to a duration of a low level of the second selecting signal;

the duration of the high level of the first selecting signal and the duration of the high level of the second selecting signal are 2K clock cycle units, and the duration of the low level of the first selecting signal and the duration of the low level of the second selecting signal are K clock cycle units, wherein K is a positive integer;

a start time of a rising edge of the high level of the second selecting signal differs from a start time of a rising edge of the high level of the first selecting signal by K clock cycle units.

5. A driving circuit for controlling a pixel array in a corresponding display panel to display images, the driving circuit comprising:

a data signal supplying module utilized to generate a data signal, the data signal utilized to be provided for the pixel array;

a first selection signal generating module utilized to provide a first selecting signal;

a second selection signal generating module utilized to provide a second selecting signal; and a selecting module, the selecting module comprising:

at least two selecting switch sets, the selecting switch sets electrically coupled to the first selection signal generating module, the second selection signal generating module, the data signal supplying module and the pixel array, the selecting switch sets utilized to receive the first selecting signal, the second selecting signal and the data signal, and utilized to output the data signal to the pixel array according to the first selecting signal and the second selecting signal; wherein the selecting switch sets comprises:

a first switch, the first switch electrically coupled to the first selection signal generating module and the data signal supplying module;

a second switch, the second switch electrically coupled to the second selection signal generating module and the data signal supplying module;

a third switch, the third switch electrically coupled to the first selection signal generating module and the data signal supplying module;

a fourth switch, the fourth switch electrically coupled to the second selection signal generating module, the third switch and a third pixel columns of the pixel array;

a fifth switch, the fifth switch electrically coupled to the second selection signal generating module, the first switch and a first pixel columns of the pixel array; and a sixth switch, the sixth switch electrically coupled to the first selection signal generating module, the second switch and a second pixel column of the pixel array.

6. The driving circuit according to claim 5, wherein the first switch comprises:

a first control terminal, the first control terminal electrically coupled to the first control terminal and the first selection signal generating module;

a first input terminal, the first input terminal electrically coupled to the data signal supplying module; and a first output terminal, the first output terminal electrically coupled to the fifth switch;

wherein the first control terminal is utilized to receive the first selecting signal, and utilized to control ON and OFF states of a first current channel between the first input terminal and the first output terminal according to the first selecting signal;

the second switch comprising:

a second control terminal, the second control terminal electrically coupled to the second control terminal and the first selection signal generating module;

a second input terminal, the second input terminal electrically coupled to the data signal supplying module; and a second output terminal, the second output terminal electrically coupled to the sixth switch;

wherein the second control terminal is utilized to receive the second selecting signal, and utilized to control ON and OFF states of a second current channel between the second input terminal and the second output terminal according to the second selecting signal;

the third switch comprising:

a third control terminal, the third control terminal electrically coupled to the first control terminal and the first selection signal generating module;

a third input terminal, the third input terminal electrically coupled to the data signal supplying module; and a third output terminal, the third output terminal electrically coupled to the fourth switch;

wherein the third control terminal is utilized to receive the first selecting signal, and utilized to control ON and OFF states of a third current channel between the third input terminal and the third output terminal according to the first selecting signal;

the fourth switch comprising:

a fourth control terminal, the fourth control terminal electrically coupled to the second control terminal and the first selection signal generating module;

a fourth input terminal, the fourth input terminal electrically coupled to the third output terminal; and a fourth output terminal, the fourth output terminal electrically coupled to the third pixel columns;

wherein the fourth control terminal is utilized to receive the second selecting signal, and utilized to control ON and OFF states of a fourth current channel between the fourth input terminal and the fourth output terminal according to the second selecting signal;

the fifth switch comprising:

a fifth control terminal, the fifth control terminal electrically coupled to the second control terminal and the first selection signal generating module;

a fifth input terminal, the fifth input terminal electrically coupled to the first output terminal; and a fifth output terminal, the fifth output terminal electrically coupled to the first pixel columns;

wherein the fifth control terminal is utilized to receive the second selecting signal, and utilized to control ON and OFF states of a fifth current channel between the fifth input terminal and the fifth output terminal according to the second selecting signal;

the sixth switch comprising:

a sixth control terminal, the sixth control terminal electrically coupled to the first control terminal and the first selection signal generating module;

a sixth input terminal, the sixth input terminal electrically coupled to the second output terminal; and a sixth output terminal, the sixth output terminal electrically coupled to the second pixel columns;

wherein the sixth control terminal is utilized to receive the first selecting signal, and utilized to control ON and OFF states of a sixth current channel between the sixth input terminal and the sixth output terminal according to the first selecting signal.

7. The driving circuit according to claim 6, wherein the first control terminal electrically coupled to the first selection signal generating module via a first signal line;

the second control terminal electrically coupled to the second selection signal generating module via a second signal line;

the third control terminal electrically coupled to the first selection signal generating module via the first signal line;

the fourth control terminal electrically coupled to the second selection signal generating module via the second signal line;

the fifth control terminal electrically coupled to the second selection signal generating module via the second signal line;

the sixth control terminal electrically coupled to the first selection signal generating module via the first signal line.

8. The driving circuit according to claim 6, wherein the first current channel is utilized to open when the third current channel is in the ON state and to close when the third current channel is in the OFF state, and utilized to close when the sixth current channel is in the ON state and to open when the sixth current channel is in the OFF state;

the second current channel is utilized to open when the fourth current channel is in the ON state and to close when the fourth current channel is in the OFF state, and utilized to close when the fifth current channel is in the ON state and to open when the fifth current channel is in the OFF state;

the third current channel is utilized to open when the first current channel is in the ON state and to close when the first current channel is in the OFF state, and utilized to close when the sixth current channel is in the ON state and to open when the sixth current channel is in the OFF state;

the fourth current channel is utilized to open when the second current channel is in the ON state and to close when the second current channel is in the OFF state, and utilized to close when the fifth current channel is in the ON state and to open when the fifth current channel is in the OFF state;

the fifth current channel is utilized to close when the second current channel is in the ON state and to open when the second current channel is in the OFF state, and utilized to close when the fourth current channel is in the ON state and to open when the fourth current channel is in the OFF state;

the sixth current channel is utilized to close when the first current channel is in the ON state and to open when the first current channel is in the OFF state, and utilized to close when the third current channel is in the ON state and to open when the third current channel is in the OFF state.

9. The driving circuit according to claim 8, wherein the first switch, the second switch, the third switch and the fourth switch are an N channel metal-oxide-semiconductor transistor, and the fifth switch and the sixth switch are a P channel metal-oxide-semiconductor transistor; or the first switch, the second switch, the third switch and the fourth switch are a P channel metal-oxide-semiconductor transistor, and the fifth switch and the sixth switch are an N channel metal-oxide-semiconductor transistor.

10. The driving circuit according to claim 5, wherein a duration of a high level of the first selecting signal is identical to a duration of a high level of the second selecting signal, and a duration of a low level of the first selecting signal is identical to a duration of a low level of the second selecting signal;

the duration of the high level of the first selecting signal and the duration of the high level of the second selecting signal are 2K clock cycle units, and the duration of the low level of the first selecting signal and the duration of the low level of the second selecting signal are K clock, cycle units, wherein K is a positive integer;

a start time of a rising edge of the high level of the second selecting signal differs from a start time of a rising edge of the high level of the first selecting signal by K clock cycle units.

11. The driving circuit according to claim 10, wherein the duration of the high level of the scanning signal is 3K clock cycle units, and the duration of the low level of the scanning signal is also 3K clock cycle units.

12. A display panel, comprising:

a pixel array; and a driving circuit, the driving circuit utilized to control the pixel array to display images, the driving circuit comprising:

a data signal supplying module utilized to generate a data signal, the data signal utilized to be provided for the pixel array;

a first selection signal generating module utilized to provide a first selecting signal;

a second selection signal generating module utilized to provide a second selecting signal; and a selecting module, the selecting module comprising:

at least two selecting switch sets, the selecting switch sets electrically coupled to the first selection signal generating module, the second selection signal generating module, the data signal supplying module and the pixel array, the selecting switch sets utilized to receive the first selecting signal, the second selecting signal and the data signal, and utilized to output the data signal to the pixel array according to the first selecting signal and the second selecting signal; wherein the selecting switch sets includes:

a first switch, the first switch electrically coupled to the first selection signal generating module and the data signal supplying module;

a second switch, the second switch electrically coupled to the second selection signal generating module and the signal supplying module;

a third switch, the third switch electrically coupled to the first selection signal generating module and the data signal supplying module;

a fourth switch, the fourth switch electrically coupled to the second selection signal generating module, the third switch and a third pixel columns of the pixel array;

a fifth switch, the fifth switch electrically coupled to the second selection signal generating module, the first switch and a first pixel columns of the pixel array; and a sixth switch, the sixth switch electrically coupled to the first selection signal generating module, the second switch and a second pixel column of the pixel array.

13. The display panel according to claim 12, wherein the first switch comprises:

a first control terminal, the first control terminal electrically coupled to the first control terminal and the first selection signal generating module;

a first input terminal, the first input terminal electrically coupled to the data signal supplying module; and a first output terminal, the first output terminal electrically coupled to the fifth switch;

wherein the first control terminal is utilized to receive the first selecting signal, and utilized to control ON and OFF states of a first current channel between the first input terminal and the first output terminal according to the first selecting signal;

the second switch comprising:

a second control terminal, the second control terminal electrically coupled to the second control terminal and the first selection signal generating module;

a second input terminal, the second input terminal electrically coupled to the data signal supplying module; and a second output terminal, the second output terminal electrically coupled to the sixth switch;

wherein the second control terminal is utilized to receive the second selecting signal, and utilized to control ON and OFF states of a second current channel between the second input terminal and the second output terminal according to the second selecting signal;

the third switch comprising:

a third control terminal, the third control terminal electrically coupled to the first control terminal and the first selection signal generating module;

a third input terminal, the third input terminal electrically coupled to the data signal supplying module; and a third output terminal, the third output terminal electrically coupled to the fourth switch;

wherein the third control terminal is utilized to receive the first selecting signal, and utilized to control ON and OFF states of a third current channel between the third input terminal and the third output terminal according to the first selecting signal;

the fourth switch comprising:

a fourth control terminal, the fourth control terminal electrically coupled to the second control terminal and the first selection signal generating module;

a fourth input terminal, the fourth input terminal electrically coupled to the third output terminal; and a fourth output terminal, the fourth output terminal electrically coupled to the third pixel columns;

wherein the fourth control terminal is utilized to receive the second selecting signal, and utilized to control ON and OFF states of a fourth current channel between the fourth input terminal and the fourth output terminal according to the second selecting signal;

the fifth switch comprising:

a fifth control terminal, the fifth control terminal electrically coupled to the second control terminal and the first selection signal generating module;

a fifth input terminal, the fifth input terminal electrically coupled to the first output terminal; and a fifth output terminal, the fifth output terminal electrically coupled to the first pixel columns;

wherein the fifth control terminal is utilized to receive the second selecting signal, and utilized to control ON and OFF states of a fifth current channel between the fifth input terminal and the fifth output terminal according to the second selecting signal;

the sixth switch comprising:

a sixth control terminal, the sixth control terminal electrically coupled to the first control terminal and the first selection signal generating module;

a sixth input terminal, the sixth input terminal electrically coupled to the second output terminal; and a sixth output terminal, the sixth output terminal electrically coupled to the second pixel columns;

wherein the sixth control terminal is utilized to receive the first selecting signal, and utilized to control ON and OFF states of a sixth current channel between the sixth input terminal and the sixth output terminal according to the first selecting signal.

14. The display panel according to claim 13, wherein the first control terminal electrically coupled to the first selection signal generating module via a first signal line;

the second control terminal electrically coupled to the second selection signal generating module via a second signal line;

the third control terminal electrically coupled to the first selection signal generating module via the first signal line;

the fourth control terminal electrically coupled to the second selection signal generating module via the second signal line;

the fifth control terminal electrically coupled to the second selection signal generating module via the second signal line;

the sixth control terminal electrically coupled to the first selection signal generating module via the first signal line.

15. The display panel according to claim 13, wherein the first current channel is utilized to open when the third current channel is in the ON state and to close when the third current channel is in the OFF state, and utilized to close when the sixth current channel is in the ON state and to open when the sixth current channel is in the OFF state;

the second current channel is utilized to open when the fourth current channel is in the ON state and to close when the fourth current channel is in the OFF state, and utilized to close when the fifth current channel is in the ON state and to open when the fifth current channel is in the OFF state;

the third current channel is utilized to open when the first current channel is in the ON state and to close when the first current channel is in the OFF state, and utilized to close when the sixth current channel is in the ON state and to open when the sixth current channel is in the OFF state;

the fourth current channel is utilized to open when the second current channel is in the ON state and to close when the second current channel is in the OFF state, and utilized to close when the fifth current channel is in the ON state and to open when the fifth current channel is in the OFF state;

the fifth current channel is utilized to close when the second current channel is in the ON state and to open when the second current channel is in the OFF state, and utilized to close when the fourth current channel is in the ON state and to open when the fourth current channel is in the OFF state;

the sixth current channel is utilized to close when the first current channel is in the ON state and to open when the first current channel is in the OFF state, and utilized to close when the third current channel is in the ON state and to open when the third current channel is in the OFF state.

16. The display panel according to claim 15, wherein the first switch, the second switch, the third switch and the fourth switch are an N channel metal-oxide-semiconductor transistor, and the fifth switch and the sixth switch are a P channel metal-oxide-semiconductor transistor; or the first switch, the second switch, the third switch and the fourth switch are a P channel metal-oxide-semiconductor transistor, and the fifth switch and the sixth switch are an N channel metal-oxide-semiconductor transistor.

17. The display panel according to claim 12, wherein a duration of a high level of the first selecting signal is identical to a duration of a high level of the second selecting signal, and a duration of a low level of the first selecting signal is identical to a duration of a low level of the second selecting signal;

the duration of the high level of the first selecting signal and the duration of the high level of the second selecting signal are 2K clock cycle units, and the duration of the low level of the first selecting signal and the duration of the low level of the second selecting signal are clock cycle units, wherein K is a positive integer;

a start time of a rising edge of the high level of the second selecting signal differs from a start time of a rising edge of the high level of the first selecting signal by K clock cycle units.

18. The display panel according to claim 17, wherein the duration of the high level of the scanning signal is 3K clock cycle units, and the duration of the low level of the scanning signal is also 3K clock cycle units.

* * * * *